US005292273A

United States Patent [19]

Giessl

[11] Patent Number: 5,292,273

[45] Date of Patent: Mar. 8, 1994

[54] WATERTIGHT CONTAINER

[76] Inventor: Klaus-Dieter Giessl, Rupertigaustr. 65, 6000 Munchen 50, Fed. Rep. of Germany

[21] Appl. No.: 777,271

[22] PCT Filed: May 29, 1990

[86] PCT No.: PCT/DE90/00398

§ 371 Date: Jan. 10, 1992

§ 102(e) Date: Jan. 10, 1992

[87] PCT Pub. No.: WO90/14989

PCT Pub. Date: Dec. 13, 1990

[51] Int. Cl.[5] ..... B63C 9/15

[52] U.S. Cl. ..... 441/123; 441/42; 441/80; 441/129

[58] Field of Search ..... 441/32, 80, 88, 90; 441/129, 130, 125–127, 132, 136, 42, 123; 220/4.21, 4.24, 4.26, 4.27, 4.33; 206/522

[56] References Cited

U.S. PATENT DOCUMENTS

| | | | |
|---|---|---|---|
| 2,326,414 | 8/1943 | Thompson | 220/4.26 X |
| 2,833,398 | 5/1958 | Marshall | 206/522 |
| 4,094,408 | 6/1978 | Ford | 220/4.27 X |
| 4,235,065 | 11/1980 | Freeman | 206/522 X |

*Primary Examiner*—Sherman Basinger
*Attorney, Agent, or Firm*—Robbins, Berliner & Carson

[57] ABSTRACT

An inflatable cushion including a watertight container adapted thereto, the container being provided with an eye for threading a carrying strap therethrough. The container includes an upper and a lower hollow part, each of which is open at the front face, and an intermediate piece whereby the container is provided with separated upper and lower cavities. The upper and lower parts are attachable directly to one another without said intermediate piece to form a cavity of about double size. The cushion is adjusted in its dimensions to the container so that it will fit into one of the separated cavities only when in a non-inflated condition. The watertightness of each one of the cavities is maintained when the other part (forming the respective other cavity) is separated from the intermediate piece.

22 Claims, 4 Drawing Sheets

WATERTIGHT CONTAINER

BACKGROUND OF THE INVENTION

This invention relates to watertight containers which may be carried by the user also during swimming or other aquatic sports.

Such containers of an approximately cylindrical shape have been known to be used as possible receptacles for stowing away jewelry and other valuable objects.

However, such known containers consist of two halves to be joined by a screw joint only, in the interior of which there is one through-going cavity.

SUMMARY OF THE INVENTION

The container according to the present invention consists of an upper part and a lower part and an intermediate piece creating thus two separate, watertight cavities, one of such cavities containing a folded, inflatable cushion which is adapted to the receiving cavity in shaping and dimensioning and further configuration. Such cushion may be used as a normal underlayer for usual sun bathing, its main purpose is however its application as rescue cushion in case of sports accidents etc. A variety of differing cushion shapes may be envisaged for such purpose, from simple slanting-edged cushions to cushions having a U-shaped cross section or depressions in the cushion center in order to keep the head of the person to be propped up in a defined position.

As a special embodiment, the relatively flat formed cushion may be shaped approximately in C-form with a recess in the center corresponding approximately to the size of the neck, so that such a cushion can be laid, when empty, around the neck of a swimmer and will keep his head upright and above the water surface after being inflated.

The watertight connection between the two parts and the intermediate piece is effected by means of a screwed joint or of an appropriate, watertight plug connection. Such joints are made in a manner that, after removal of the intermediate piece, selectively an upper part and a lower part may also directly be connected for obtaining a cavity of about double size. This, however, will be realized in exceptional cases only, because the normal use will be that one of said cavities houses the inflatable cushion whereas valuable goods will be stored in the other, protected against water.

The user carries said watertight container either attached to a carrying strap laid around his neck, which is threaded through an eye of the container, or attached to his bathing suit by means of a fastening clip attached to the outer wall of one of the two parts. Said container may have a circular cross section as needed for a threaded joint, either tapering from below upward, or may have its widest cross section also in the area of the intermediate piece.

In shaping the cushion, attention must be paid to arranging the feed hose attachment for inflating the cushion at an appropriate spot so that it juts out of the opening when the folded or rolled-up cushion is introduced into its respective cavity, so that this feed hose attachment will have, at the same time, the function of a handle for pulling the cushion out of the cavity. For this purpose, this feed hose attachment is to be fastened preferably to one end of the shortest edge of the cushion as the cushion will be rolled up around said shortest edge for shoving said roll into the cavity of the container.

In order to be in a position of taking said cushion out of the container in a most simple way, said feed hose attachment for blowing up the cushion will be shaped advantageously in the form of a nipple, i.e. it will be provided at one end with a flattened thickening. The intermediate piece may then show a recess adapted to said nipple shape into which the nipple is fitted in. This will have the effect that, on removing the said intermediate piece from the respective part of the container, the folded up cushion is automatically pulled out of the container.

BRIEF DESCRIPTION OF THE DRAWINGS

In the following, some embodiments in accordance with the invention will be shown by way of examples, taking reference to the attached drawings. In such drawings show.

DETAILED DESCRIPTION

Figure 1:
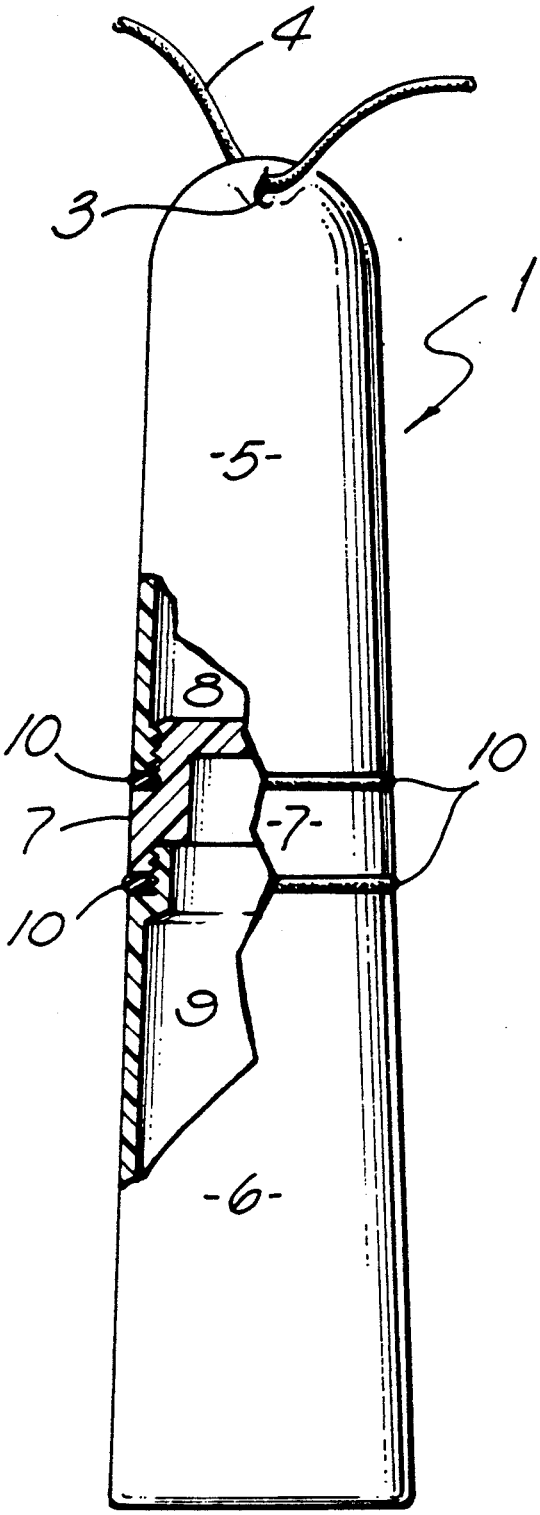
FIG. 1 the closed container including the said intermediate piece.

FIG. 1 shows the container in its closed condition, consisting of the upper part 5, the lower part 6, the intermediate piece 7 and the sealings 10 as represented in FIG. 1.

In the left part of FIG. 1, the container is shown in a break-away representation in the area of the intermediate piece 7, there the threads are recognizable by means of which the lower part 6 is screwed into the intermediate piece 7, and the intermediate piece 7 is screwed into the upper part 5. A circular, circumferential sealing 10 is disposed there between the various parts each for sealing the thread. Such threads have the same specified diameter each so that, after removal of the intermediate piece 7, the lower part 6 may be screwed directly into the upper part 5. Since the sealings 10 are placed each on those parts which carry the respective male screw thread, the upper sealing 10, referring to FIG. 1, will remain on the intermediate piece 7 whereas the lower sealing 10 will remain on the lower part 6, so that, on screwing the lower part 6 to the upper part 5, there is one sealing present between the two parts.

Figure 6:
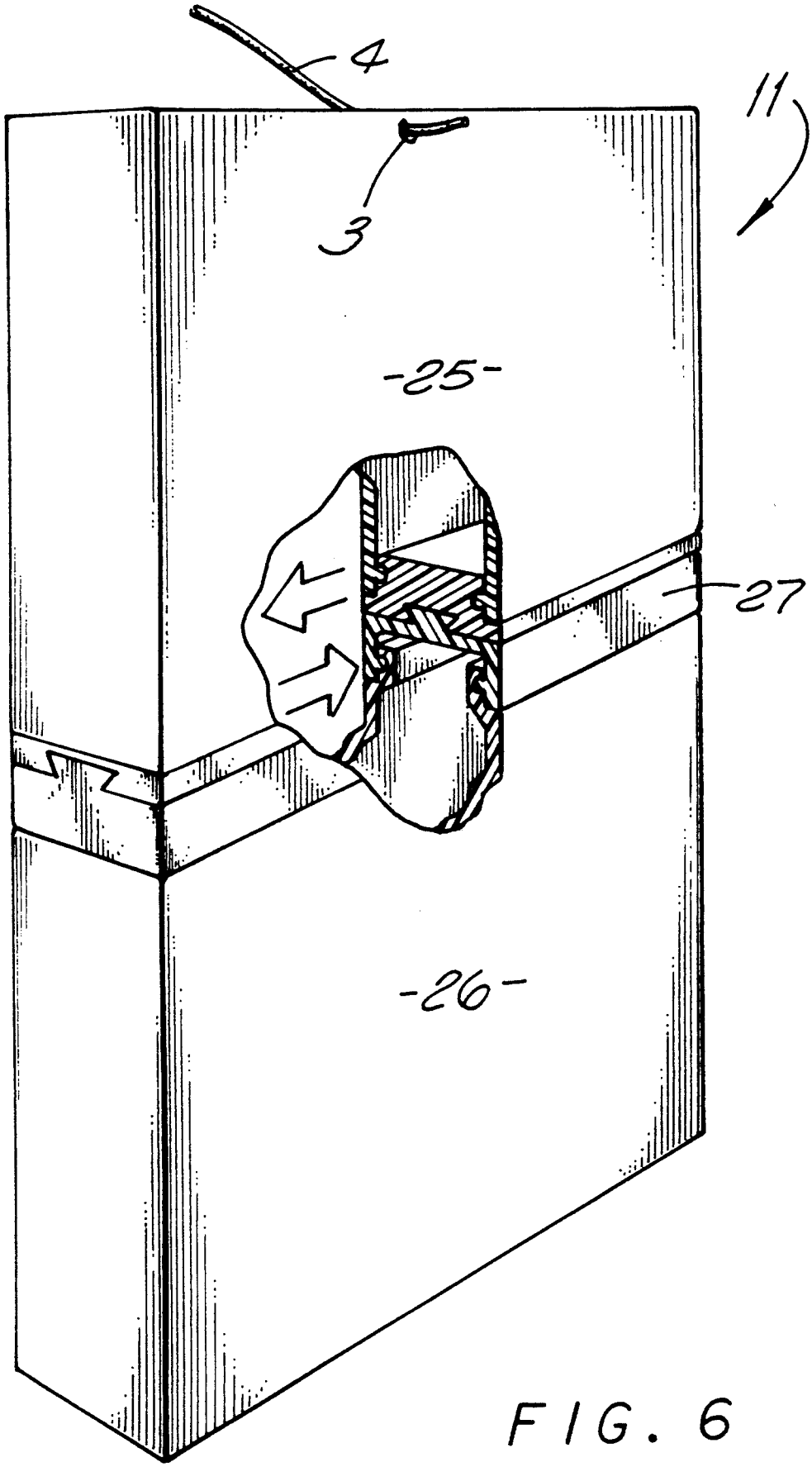
FIG. 6 a representation of the container having a flat, rectangular cross sectional shape.

Whereas FIG. 1 shows the total container 1 having a circular cross section as required for a thread, and increasing slightly from above downward, FIG. 6 shows an embodiment of a container 1 which is made flat having a substantially rectangular cross section and likewise consisting of an upper part 25 and a lower part 26 the upper part 25 slightly tapering toward the upper edge. Both in FIG. 1 and in FIG. 6, an eye 3 is provided in the vicinity of the upper edge of the container which serves for accepting a carrying strap 4. Since the solution with the rectangular cross section does not permit a screw joint by means of a thread, a plug connection has been selected in FIG. 6, the watertightness being guaranteed by means of a circumferential projecting bulge mating with a circumferential groove of respective shape formed in the engaging part. The various parts must be provided with sufficient resilience for engaging watertight into one another so that they are preferably made of plastic material.

A specialty of the solution in accordance with FIG. 6 is that there the intermediate piece 27 is again divisible into two parts, so that the one part of the intermediate piece 27 can remain attached to the upper part 25 of the container for closing such part, whereas the other part of the intermediate piece 27 can remain attached to the lower part 26 of the container for closing that part. The separation according to FIG. 6 is possible by shifting the two parts of the intermediate piece 27 with respect to one another along the junction plane and joining them respectively separating them by means of a kind of dovetail guide or the like. Thereby the container 11 may be divided into two separate containers each of which is closed watertight in itself, which can be connected by a simple manipulation to make a single container 11.

Also in that case it is guaranteed by appropriately shaping the beads or the respective counterparts, the circumferential grooves, that the intermediate piece 27 can be left off, and an upper part 25 and a lower part 26 of the container 11 directly engage into one another for obtaining a large, through-going cavity instead of the cavities 8 and 9, as it is possible also with the container in FIG. 1.

Whereas it is absolutely required, in case of the plug connection of FIG. 6, that the material is sufficiently flexible for engaging or disengaging said plug connection, it is necessary, in case of the screw joint according to FIG. 1, that the parts of the container be sufficiently rigid, at least in the area of the threads, for guaranteeing a uniform and constant compression of the sealings 10 and therewith a sufficient tightness of the cavities 8 and 9. On the other hand, it is desirable to make the container in its totality as much as possible soft and resilient, thus increasing not only the easiness of carrying it but minimizing the risk of hindrance and injuries. In addition, it is desirable for various reasons to treat the material of which container 1 or its upper and lower parts 5 and 6 are made comprising odorous substances which would continuously emanate during a long period of time. The emanation of odorous substances is advantageous, on the one hand for better marketing, in case the container 1 is shaped in its outer form resembling e.g. a fruit or an animal, as in such case the implanted odorous matters could correspond to that of the represented fruit etc. On the other hand, the inclusion and permanent emanation of odorous substances could be advantageous also for safety reasons. On the one hand, at present the synthetization of odoriferous substances which have a deterring effect upon certain fish species is about to be achieved, a feature which may be used e.g. for the protection of divers from fish of prey such as shark. On the other hand, such odorous matters could be used also for easier finding a missing person.

The possibility of integrating odorous substances depends however on the respective type of basic plastic used. There it was shown, that the integration of such odoriferous substances, and especially their uniform emanation in small quantities, may be effected in a very simple manner, in particular with soft and deformable plastics. For such reasons, preferably soft plastic should be used for producing at least part of the said container. Since, however, particularly screwed joints must consist of rigid material because otherwise the watertightness of such screwed joint in screwed-up containers cannot be guaranteed, only the parts averted from the screw threads of the upper and lower parts 5 or 6 may be selected for being made of soft plastic. The threads themselves and preferably the whole intermediate piece 7 must be made of a relatively hard material.

Figure 2:
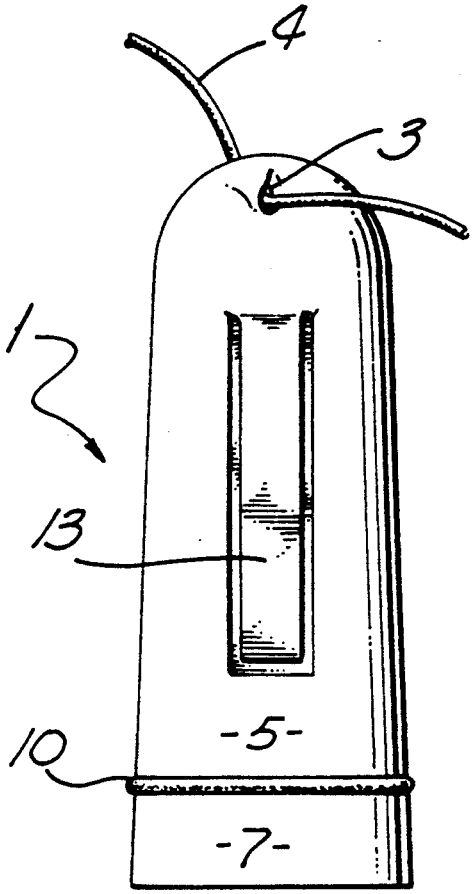
FIG. 2 the upper part of the said container with the clip disposed at the back outer wall of said upper part for hooking the container to the bathing suit.

FIG. 2 shows the container 1 seen from the reverse side consisting of the upper part 5 and the intermediate piece 7 only. The lower part 6 in the case under consideration has been taken off, and therefore only one sealing 10 is visible between the upper part 5 and the intermediate piece 7 in FIG. 2, the lower sealing 10 of FIG. 1 being removed together with the lower part 6. Since the intermediate piece 7 is tight in cross direction with respect to the longitudinal axis of the container 1, a tightly closed cavity 8 is present in the upper part 5, such as e.g. needed for conserving valuable objects. For that reason, the interior diameter of the upper part 5 should at least have the size of a 2-DM coin.

Furthermore, the clip 13 can be seen in FIG. 2, which is worked into the backward outer side of the upper part 5 so that it will be possible e.g. to hook the container 1 into the clothing by means of such a clip 13. The clip itself may be made of the same material as the upper part 5 being thereby integral with same, but also of a separate material such as stainless metal which is firmly connected to the upper part 5 of the container 1 for example by rivets.

FIGS. 3*a*–3*e* show differing embodiments of the cushion 2. Whereas the cushion shapes of the FIGS. 3*a*–3*e* serve for an as comfortable as possible—in cases of emergency also safe—bedding of the head on a hard subsoil, the cushion shape according to FIG. 3*e* serves quite another purpose.

Figure 3A:
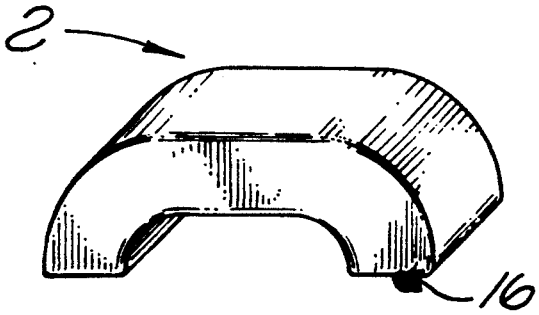
FIG. 3*a* through 3*e* various different embodiments of the said cushion.

FIG. 3*a* shows a cushion with a substantially U-shaped cross section. In that embodiment, the free legs of the U may be placed upon the subsoil whereas the head to be propped up rests on the connecting crosspiece. In that manner, not only a variation of the support height but also a variation of the resiliency of the cushion 2 may be set by variation of the air pressure on inflating. In addition, this U-shape has the advantage that in cases where a support of the head as stable as possible is a requirement such as in the case of accident victims, the U-shaped contour may be reversed so that the head is supported in the clearance between the legs of the U standing up which secure the head against toppling over to the side. The large outer radius at the transition between the connecting crosspiece and the free outer legs causes thereby a good propping of the central area as opposed to the free legs depending on increased inflating pressure.

Figure 3B:
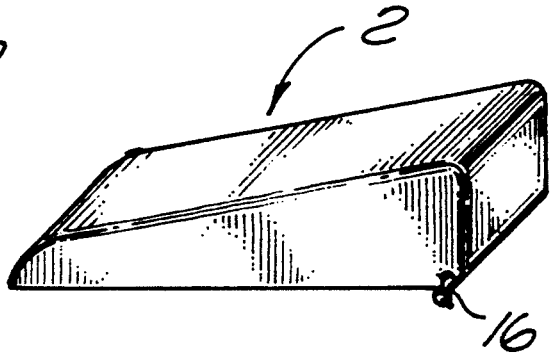
Figure 3C:
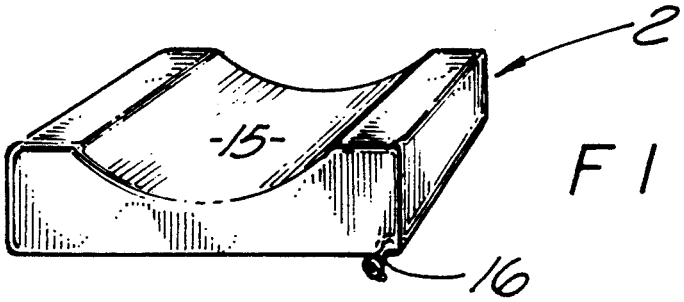

Contrary thereto, the shape of FIG. 3*c* constitutes a modification in which the outer contour of the U is made in angular form. Although this shape causes a somewhat worse support behavior when the cushion is placed upside down upon its free legs with the recess downward, yet the production of the inflatable cushion consisting mostly of rectangular cut pieces is considerably simplified.

Reasons of production favor therefore also a shape according to FIG. 3*b*, the basic form of which was a rectangular parallelepipedon the largest sides of which lying opposite to one another are not parallel but disposed in a slightly angular position with respect to one another, resulting thus in a slopingly ascending support face which allows a comfortable propping of the head.

Figure 3D:
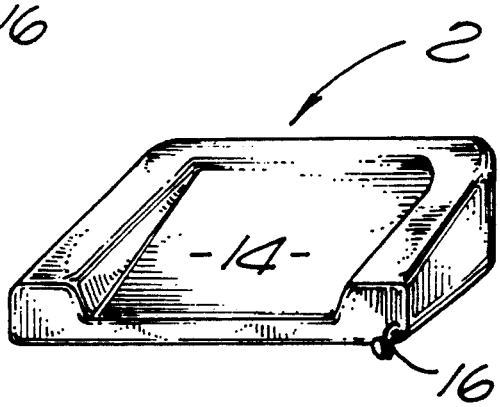

In comparison thereto, the shape of the cushion of FIG. 3*d* could be considered to be a combination of the advantages of FIGS. 3*b* and 3*c*, because this cushion shape consists exclusively of parts with straight faces despite the relatively complicated form, i.e. a basic shape in accordance with FIG. 3*b* with a worked-in depression which is open toward the narrow front face, allowing thus an uncomplicated production in the form of an inflatable cushion.

All those cushion 2 shapes must certainly be based upon the adjustment to the interior space of the lower part 6 of the container, because the cushion must be easily introducible into that cavity 9 in a folded or rolled-up condition. Advantageously, the cushion, empty of air, is therefore rolled up after perhaps having been folded up once or twice, making thus a cylindrically rolled body in correspondence with the cylindrical interior shape of the cavity 9. On shaping the cushion it must be taken into consideration that the hose attachment 16 for inflating the cushion 2 must be attached in a manner that it is directed toward the opening of said cavity 9 after the cushion is stowed away in said cavity 9. This is achieved if said hose attachment 16 is placed at the end of one edge of the cushion 2 which is thus situated if the cushion is rolled up, on folding, around an axis extending parallel thereto. That will be, as a rule, the shortest outer edge which defines one of the three directions of the approximately parallelepipedal basic shape of the cushion 2. So e.g. the cushion shape of FIG. 3*b* is a flat parallelepipedal shape so that the vertical edges of said cushion represent the shortest distances in the three space axes. That is the reason why said hose attachment 16 should be placed at the end of one of the vertical edges which, however, not necessarily must be the shortest one of said vertical edges.

Figure 3E:
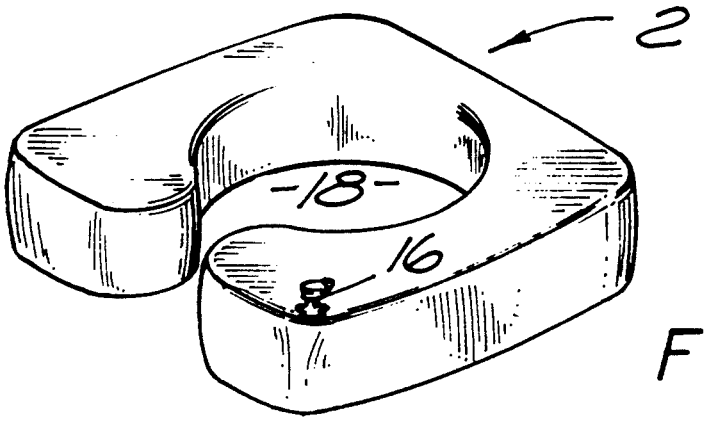

The same applies evidently also for the shape of the cushion 2 as represented in FIG. 3*e*. Such cushion has the form of a rectangular parallelepipedon or also as shown in FIG. 3*b*, said cushion representing an approximately C-shaped form when seen from above. This means, that the free legs of such C-shape strongly approach one another in the front area of the cushion leaving, however, a clearance 18 in the center of the cushion 2, which has approximately a size so that such cushion 2 can be laid around the neck when being in a non-inflated condition. If such cushion is subsequently inflated, it is no more possible to remove said cushion 2 from the neck due to the inflation pressure, so that said cushion shape has the same effect on a swimmer as a lifesaving jacket, i.e. propping the head in a vertical direction and holding it above the water surface. In order to making it easier for the user to lay the cushion around his neck and to inflate it by himself, it is required that the hose attachment 16 for inflating the cushion 2 is attached to the front edge of the cushion, in order to allow the inflation of the cushion 2 even after it has been laid around his neck.

Advantageously, the cushion 2 is still further adjusted to the cavity of the container 1 in which it is to be accommodated. Since the lower cavity 9 is usually provided for such purpose, the hose attachment 16 for inflating the cushion 2 is configured in the form of a nipple, i.e. it will be provided with a thickened head as compared with the neck of such hose attachment. Such thick head, on the one hand, facilitates the seizing of the hose attachment 16 which serves, in addition to inflating the cushion 2, also for pulling the cushion out of the container 1. Such nipple form of the hose attachment 16 with its special configuration serves for being attached to the intermediate piece 7.

Figure 4:
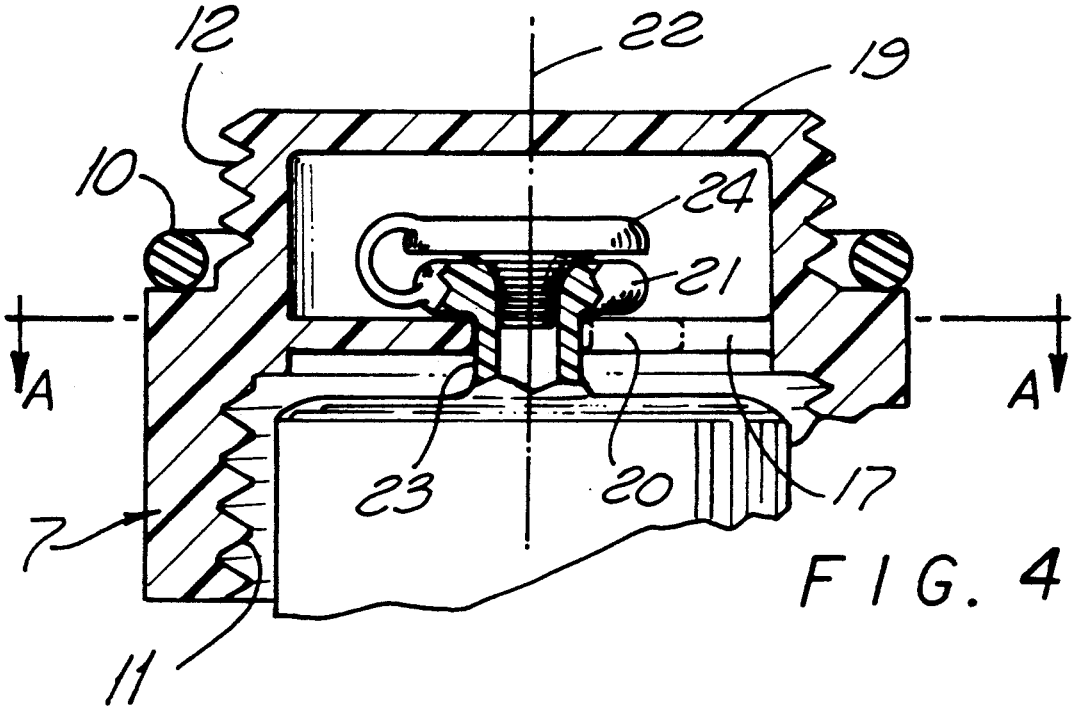
FIG. 4 a cross sectional representation of a special embodiment of the intermediate piece and of the said feed hose attachment for inflating the said cushion.
Figure 5:
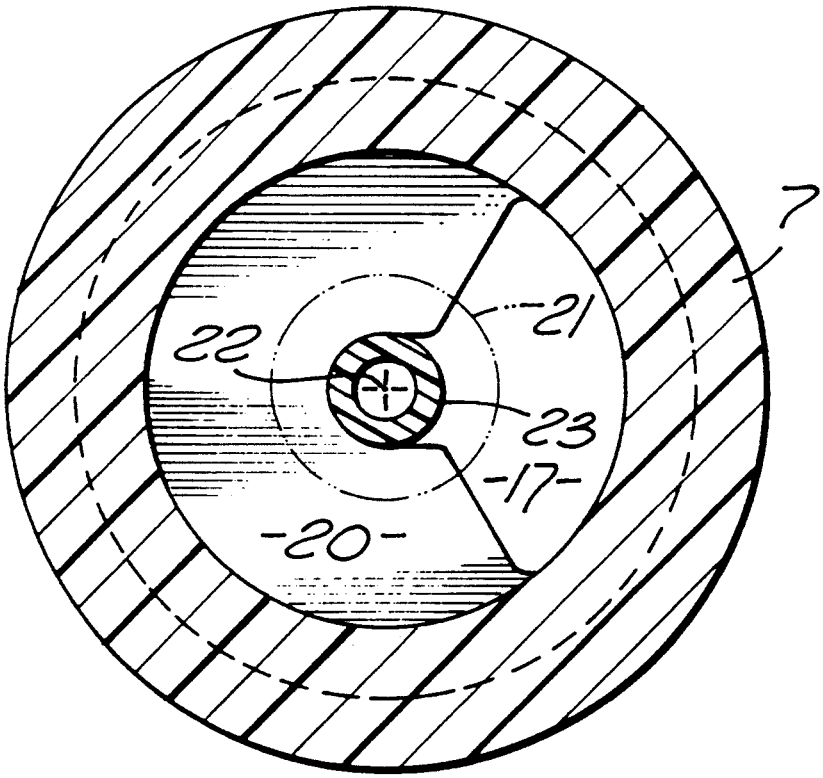
FIG. 5 a cross sectional representation along the line A—A in FIG. 4.

As FIGS. 4 and 5 show, the intermediate piece 7 is provided in addition to the through-going transversal plane 19 required for sealing the cavity 8 or 9 respectively, with another transversal plane 20 being present only in part. The distance between those two transversal planes is sufficient for accommodating the thickened head 21 of the nipple-shaped hose attachment 16. Such second transversal plane 20 extends from the one side of the intermediate piece 7 to beyond the center, however, leaves open a recess 17 in the area of the axis of symmetry 22 of the intermediate piece 7, which has just the dimension required for laying-in the shaft 23 of the hose attachment 16. Due to this arrangement, the hose attachment 16 can be placed into said recess 17 of the transversal plane 20 of the intermediate piece 7 and can be clamped there if adequately dimensioned, the thickened head 21 of the hose attachment 16 being placed between the two transversal planes 19 and 20 of the intermediate piece 7.

Due to this arrangement it is possible to pull the cushion 2 out of the lower cavity 9 immediately on detaching the intermediate piece 7 from the lower part 6 or 26 respectively without bothering to seize the small hose attachment 16 being placed within the cavity 9 and pulling it out.

It is self-evident that an integral cover 24 is connected to the head 21 of the hose attachment 16 as shown in FIG. 4, said cover 24 being provided with a locking plug for closing the blow-up opening of the hose attachment 16 after inflating, as generally known for any inflatable objects. Most certainly also a ball valve or a similar automatically acting closing member could be used instead of such a hose attachment to be manually closed, if only the outer contours satisfy the above described adjustment requirements.

If, on the other hand, it is not preferably required to obtain a total cavity in the size of the sum of the cavities 8 and 9, the intermediate piece 7 and the lower piece 6 could be configured identically in a preferred embodiment, i.e. with an opening and a male screw thread in the upper area and an approximately cylindrical interior space and a cylindrical outer contour, and a lower bottom not placed at the lowermost point of that part but somewhat shifted upward, so that a female screw thread could be made in the likewise cylindrical socket placed below it. Such configuration would allow to screw a plurality of intermediate pieces 7 or lower parts 6 to one another creating thus any number of watertight cavities 9. The upper part 5 then would correspond to the form as described above, the axial length of the said upper part 5 being selected in view of the total length of the thus created cavities 8. In this respect, said upper part 5 may be configured so short that it substantially contains no upper cavity 8 at all but represents only a lid for sealingly closing the lower cavity 9.

I claim:

1. Inflatable cushion comprising a watertight container adapted thereto, said container being provided with an eye for threading a carrying strap therethrough, said container comprising an upper and a lower hollow part each open at a front face and an intermediate piece whereby the container is provided with separated upper and lower cavities, the upper and lower part respectively being attachable directly to one another without said intermediate piece to form a cavity of about double size, the cushion being adjusted in its dimensions to the container so that it will fit into one of the separated cavities only when in a non-inflated condition in a folded or rolled-up form, the watertightness of each one of said cavities being maintained when the other part forming the respective other cavity is separated from the intermediate piece.

2. A cushion in accordance with claim 1, wherein said eye is disposed at an upper edge of the upper part and the cushion is placed in the lower cavity.

3. A cushion in accordance with claim 1, wherein the cross section of the container is continuously increasing in a downward direction.

4. A cushion in accordance with claim 2, wherein a clip for hooking said container to an external object is worked into an outer face of the container.

5. A cushion in accordance with claim 1, wherein one of said parts is provided with a female screw thread of a specified diameter and the second of said parts is provided with a male screw thread complementary to the female screw thread, and said intermediate piece is provided with a female screw thread of the specified diameter and a male screw thread complementary to the female screw thread.

6. A cushion in accordance with claim 1, wherein the two parts and the intermediate piece are provided with watertight plug connections.

7. A cushion in accordance with claim 1, wherein the intermediate piece comprises a hard plastic and the upper and lower parts comprise at least in part a soft plastic.

8. A cushion in accordance with claim 1, wherein said cushion is configured in a U-shape formed by free legs thereof, the length of the free legs of such U-shape cross section being a smallest extension of the cushion.

9. A cushion in accordance with claim 1, wherein a shortest edge of said cushion is shorter than a longest length of the lower cavity of the container.

10. A cushion in accordance with claim 1, wherein said cushion has the form of a square parallelogram with a slanting surface.

11. A cushion in accordance with claim 10, wherein said slanting surface of the cushion has a recess which is surrounded with a protruding border on three sides.

12. A cushion in accordance with claim 1, wherein the cushion has a depression with a circular cross section.

13. A cushion in accordance with claim 1, wherein the cushion has an approximately C-shaped form if seen from above, a clearance of which disposed approximately in the center corresponding to the diameter of the neck of a human being.

14. A cushion in accordance with claim 1, wherein a hose attachment for inflating the cushion is disposed on the cushion in such a manner that upon accommodating the cushion in a folded-up condition in a cavity of the container, said hose attachment points in a direction towards an opening of such cavity.

15. A cushion in accordance with claim 14, wherein the hose attachment comprises a shaft and a head which is thickened with respect to said shaft.

16. A cushion in accordance with claim 15, wherein said intermediate piece comprises a first transverse plane at a first end thereof and a second transverse plane at a second opposite end thereof, said second transverse plane being provided with a recess into which fits the shaft of the hose attachment, whereby the thickened head of said hose attachement is accommodated between the two transverse planes of the intermediate piece.

17. A cushion in accordance with claim 1, wherein the container has a flat, approximately rectangular cross section.

18. A cushion in accordance with claim 1, wherein the intermediate piece comprises two parts separable across an axis of symmetry by pushing the two parts asunder, whereby two sealed part containers are created together with the two parts.

19. A cushion in accordance with claim 1, wherein the container is impregnated with at least one odoriferous substance.

20. A cushion in accordance with claim 19, wherein said odoriferous substance is selected from the group consisting of fruit scents and shark repellents.

21. Inflatable cushion comprising a watertight container adapted thereto, said container being provided with an eye for threading a carrying strap therethrough, said container comprising an upper and a lower hollow part each open at a front face and an intermediate piece whereby the container is provided with separated upper and lower cavities, the upper and lower part respectively being attachable directly to one another without said intermediate piece to form a cavity of about double size, the cushion being adjusted in its dimensions to the container so that it will fit into one of the separated cavities only when in a non-inflated condition in a folded or rolled-up form, the watertightness of each one of said cavities being maintained when the other part forming the respective other cavity is separated from the intermediate piece, said intermediate piece comprising a first transverse plane at a first end thereof and a second transverse plane at a second opposite end thereof, said cushion further comprising a hose attachment for inflating the cushion, said hose attachment comprising a shaft and a head which is thickened with respect to said shaft, said second transverse plane being provided with a recess into which fits the shaft of the hose attachment, whereby the head of said hose attachment is accommodated between the two transverse planes of the intermediate piece.

22. Inflatable cushion comprising a watertight container adapted thereto, said container being provided with an eye for threading a carrying strap therethrough, said container comprising an upper and a lower hollow part each open at a front face and an intermediate piece whereby the container is provided with separated upper and lower cavities, the upper and lower part respectively being attachable directly to one another without said intermediate piece to form a cavity of about double size, the cushion being adjusted in its dimensions to the container so that it will fit into one of the separated cavities only when in a non-inflated condition in a folded or rolled-up form, the watertightness of each one of said cavities being maintained when the other part forming the respective other cavity is separated from the intermediate piece, wherein the intermediate piece comprises two parts separable across an axis of symmetry by pushing the parts asunder, whereby two sealed part containers are created together with the two parts.

* * * * *